United States Patent [19]

Guarr

[11] 4,441,345

[45] Apr. 10, 1984

[54] LOCK DEVICE FOR VEHICLE HOODS

[76] Inventor: David A. Guarr, 6130 Westgate, Shawnee, Kans. 66216

[21] Appl. No.: 340,649

[22] Filed: Jan. 19, 1982

[51] Int. Cl.[3] ..... E05B 65/12; E05C 3/04

[52] U.S. Cl. ..... 70/240; 292/209; 292/DIG. 14

[58] Field of Search ..... 70/240–241, 70/201, 202, 209, 210, 212; 292/202, 209, 224, 227, 228, DIG. 14, DIG. 43

[56] References Cited

U.S. PATENT DOCUMENTS

| | | | |
|---|---|---|---|
| 3,199,322 | 8/1965 | Braun | 70/240 |
| 3,392,557 | 7/1968 | Solow | 70/240 |
| 3,796,076 | 3/1974 | Miyabayashi | 70/240 |
| 3,979,144 | 9/1976 | Bascou | 292/216 |

FOREIGN PATENT DOCUMENTS

| | | | |
|---|---|---|---|
| 1289306 | 9/1972 | United Kingdom | 70/240 |

*Primary Examiner*—Robert L. Wolfe

*Attorney, Agent, or Firm*—Kokjer, Kircher, Bradley, Wharton, Bowman & Johnson

[57] ABSTRACT

A lock device for locking the hood of a vehicle equipped with a pivotal latch. A mounting bracket is bolted to the vehicle at a location adjacent to the hood latch behind the vehicle grill. A key operated cylinder lock carries a cam which controls a spring loaded locking arm. A flange on the locking arm engages the latch release lever to prevent it from releasing the hood when the cylinder lock plug is turned to the locked position. The cam releases the locking arm when the cylinder lock is unlocked, and a spring pulls the locking arm away from the release lever to permit unlatching of the hood. In a modified form of the lock device, the cam acts directly against the latch release lever to provide the sole means for operating the latch.

8 Claims, 4 Drawing Figures

LOCK DEVICE FOR VEHICLE HOODS

BACKGROUND AND SUMMARY OF THE INVENTION

This invention relates generally to lock devices and more particularly to a lock device used to prevent unauthorized opening of a vehicle hood.

Automobiles and other vehicles typically have a releasable latch which normally holds the hood closed on the engine compartment. In order to prevent unauthorized opening of the hood, many modern vehicles are equipped with an under the dash hood release located inside of the enclosed passenger compartment. When the vehicle doors are locked, the hood release is inaccessible due to its location within the locked passenger compartment. However, this type of hood release is not applicable to JEEP vehicles and other topless or cloth topped vehicles which do not have enclosed passenger compartments.

One attempt to provide a lock for an engine compartment hood is disclosed in U.S. Pat. No. 3,392,557 to Solow. This type of arrangement is useful only with pull forward latch releases and is inapplicable to the side pivoting hood releases that are most common on topless and cloth topped vehicles. Mounting of the Solow device on the vehicle is also a difficult and time consuming task which requires special tools and mounting hardware. Furthermore, release of the Solow lock involves complete removal of the cylinder lock plug, and the loose plug can be lost or misplaced. Since the lock mechanism is not enclosed, dirt, bugs and other debris can clog the mechanism and the lock is accessible and thus easily tampered with.

The present invention is directed to an improved hood lock which is constructed in a simple and economical manner and which is easily installed without the need for special tools or hardware. In accordance with the invention, a metal bracket is mounted behind the grill of a vehicle next to the latch release lever. A key operated cylinder lock is accessible through the grill and has a cam that turns with the plug of the lock. When the plug is turned by the key, the cam acts against a locking arm and forces it against the release lever such that the lever cannot be moved in a direction to release the latch. The cam releases the locking arm and a spring pulls it away from the release lever when the plug is turned in the opposite direction to open the lock. The mounting bracket covers the front of the device to shield it from foreign material and tampering.

In a modified form of the invention, the locking arm is eliminated, and the cam acts directly against the release lever to manipulate the latch. The key operated cylinder lock provides the only means for operating the latch and allowing the hood to be opened. In this arrangement, a front plate of the mounting bracket completely covers the release lever to prevent it from being operated other than by means of the key.

DETAILED DESCRIPTION OF THE INVENTION

In the accompanying drawing which forms a part of the specification and is to be read in conjunction therewith and in which like reference numerals are used to indicate like parts in the various views.

Figure 1:
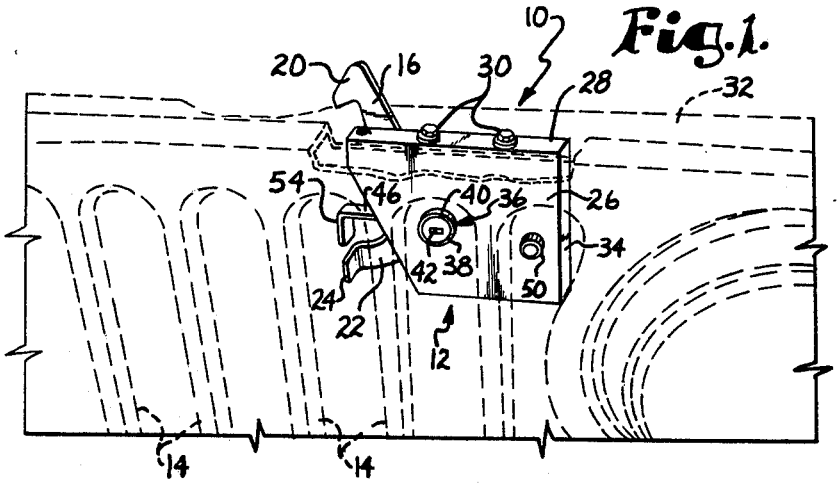
FIG. 1 is a perspective view showing a vehicle grill equipped with a hood lock device constructed according to a preferred embodiment of the present invention.
Figure 2:
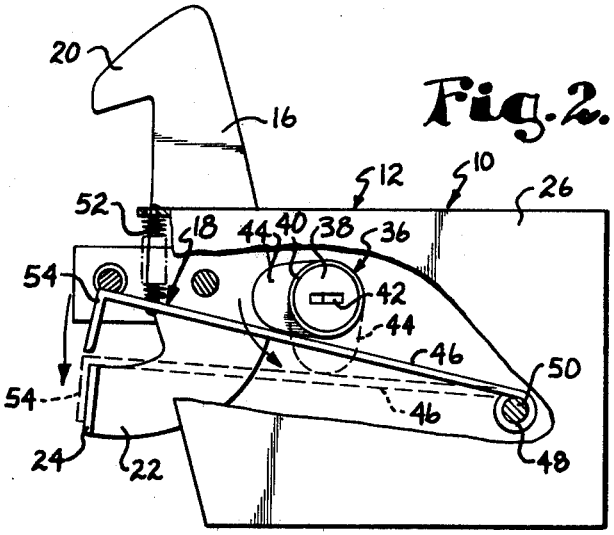
FIG. 2 is a front elevational view of the lock device on an enlarged scale, with a portion broken away for purposes of illustration and the solid lines illustrating the unlocked position of the locking arm.
Figure 3:
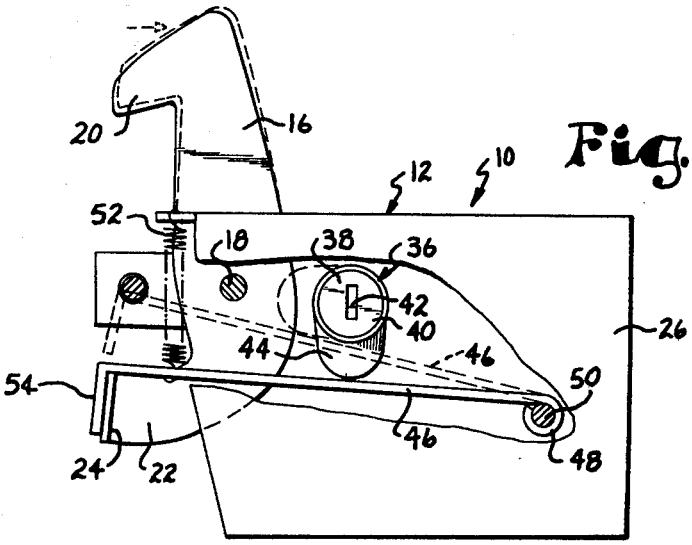
FIG. 3 is a front elevational view similar to FIG. 2 showing the locked position of the locking arm.

Referring now to the drawing in detail and initially to FIGS. 1–3, numeral 10 generally designates a lock device constructed in accordance with a preferred embodiment of the present invention. The lock device 10 includes a mounting bracket 12 which serves to mount the device behind a grill 14 such as the grill of a JEEP vehicle or another open topped or cloth topped vehicle in which an under the dash hood release is inappropriate due to the lack of an enclosed passenger compartment. The vehicle has a side pivoting latch 16 which is mounted to the vehicle for pivotal movement about a pivot pin 18. The latch 16 has a hooked end portion 20 which normally fits on a latch bar or the like on the engine compartment hood (not shown) in order to latch the hood in the closed position.

Integral with the latch 16 is a release lever 22 which terminates in a handle 24 that is accessible through the grill 14. A tension spring normally holds the latch 16 closed, and the force of the spring can be overcome by pulling the handle 24 to the left in a direction to pivot latch 16 to the release position wherein it releases from the latch bar and permits the hood to be raised.

The mounting bracket 12 of the lock device 10 includes a front plate 26 which covers the pivot pin 18 and the central portion of latch 16 and release lever 22 when the device is mounted on the vehicle. A flange 28 is turned rearwardly from the top edge of the front plate 26 and is provided with a pair of holes for receiving bolts 30 used to secure the mounting bracket to the vehicle. Flange 28 is located immediately beneath a short panel 32 extending rearwardly on the vehicle above grill 14. Latch 16 projects upwardly through the panel 32, and bolts 30 serve to attach bracket 12 to the vehicle at a location immediately behind the grill 14 with plate 26 covering the center of the latch and release lever structure. Another flange 34 is turned rearwardly from one side edge of the front plate 26.

A conventional key operated cylinder lock 36 or any other suitable type of lock is mounted on bracket 12 and extends rearwardly from the front plate 26. The cylinder lock includes a plug 38 received within a cylinder 40 and having a key hole 42 on its forward end. When the appropriate toothed key (not shown) is inserted in the key hole 42, plug 36 can be turned within cylinder 40 between the positions shown in FIGS. 2 and 3. When plug 38 is in either of these positions, it is locked in place and can be turned only upon insertion of the appropriate key in the key hole. The key hole 42 is accessible from the front of plate 26 through grill 14 of the vehicle.

Mounted on the plug 38 of the cylinder lock is a cam 44 which interacts with a locking arm 46. Arm 46 is mounted on bracket 12 for pivotal movement adjacent the back surface of plate 26. A eye 48 on the end of the arm receives a rivet 50 secured to the front plate 26. The central portion of locking arm 46 is contacted by cam 44, and the cam acts to pivot arm 46 between the positions shown in solid and broken lines in FIG. 2. Arm 46 is continually urged upwardly toward the solid line position of FIG. 2 by a tension spring 52 which is hooked to arm 46 at one end and to flange 28 at the other end. The free end of locking arm 46 is provided with a downturned flange 54 which engages handle 24 of the latch release lever 22 when arm 46 is moved to the locking position shown in broken lines in FIG. 2.

In use, the lock device 10 can be easily installed simply by utilizing the bolts 30 which serve to securely mount bracket 12 to the vehicle immediately behind grill 14. The key hole 42 is exposed through the grill and yet is not readily noticeable except on close inspection. It is noted that no special tools and no specialized mounting hardware items are needed to secure the lock device to the vehicle.

When the cylinder lock 36 is in the unlocked position shown in FIG. 2, spring 52 raises locking arm 46 to the solid line position wherein the flange 54 is free of handle 24 of the release lever 22. Handle 24 can then be pulled to the left in order to pivot latch 16 to the release position, thereby permitting the vehicle hood (not shown) to be raised to provide access to the engine compartment.

When the key (not shown) of the cylinder lock is used to turn plug 38 to the position shown in FIG. 3, cam 44 pushes arm 46 generally downwardly about rivet 50 by camming action. When the fully locked position of FIG. 3 is reached, the key is removed and cam 44 holds locking arm 46 against the force of spring 52 such that flange 54 engages the side surface of handle 24. Then, handle 24 cannot be pulled to the left far enough to release latch 16, and the hood is securely locked in the closed position covering the engine compartment. The hood can be released only by inserting the key in key hole 42 and turning plug 38 to the release position shown in solid lines in FIG. 2. Spring 52 then raises locking arm 46 to permit the latch to be released for opening of the hood.

The front plate 26 of the mounting bracket 12 covers spring 52, the majority of locking arm 46 and the central portion of the hood latch and release lever. Consequently, the mounting bracket shields the components of the lock device against tampering and possible clogging by bugs, dirt and other foreign materials. At the same time, only those having the proper key are able to lock and unlock the hood.

Figure 4:
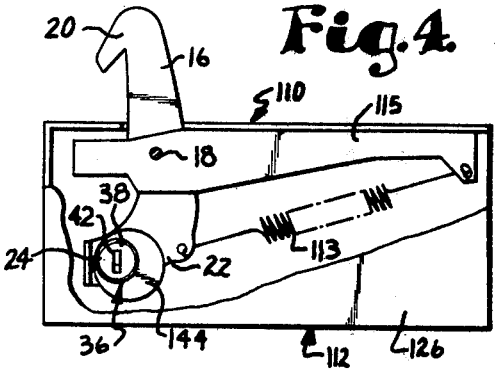
FIG. 4 is a front elevational view of a modified form of the invention, with a portion broken away for purposes of illustration.

Referring now to FIG. 4, a modified lock device 110 includes a mounting bracket 112 which is generally similar to the bracket 12 shown in FIGS. 1–3. The lock device 110 is used with the same type of side pivoting latch shown in FIGS. 1–3. The latch 16 is urged toward the latching position by a tension spring 113 which is hooked at one end to the release lever 22 and at the opposite end to a stationary arm 115 secured to the vehicle. Latch 16 pivots with respect to arm 15 about the pivot pin 18.

The lock device 110 shown in FIG. 4 does not require the locking arm 46 or spring 52. Instead, an eccentric cam 144 secured to the back end of the plug 38 is located adjacent to the right side of handle 24 of the release lever 22. When the cylinder lock 36 is in the unlocked position shown in FIG. 4, the low part of cam 144 contacts handle 24, and spring 113 maintains latch 16 in the latched position. However, when a proper key is used to turn plug 38 through a 180° arc, the lobe or high part of cam 144 acts against handle 24 by camming action to effect release of the release lever 22, thus pivoting latch 16 to the unlatched position and permitting the hood to be opened. When the cam 144 is turned back to the position of FIG. 3, spring 113 returns the latch to the latched position.

Mounting bracket 112 includes a front plate 126 which completely covers the release lever 22 and handle 24 when the bracket is installed on the vehicle. Bracket 112 includes a flange similar to flange 28 for mounting of the lock device 110 immediately behind the grill 14 in substantially the same location as lock device 10 is mounted. Since the release handle 24 is completely covered by plate 126, it is inaccessible and cannot be operated by hand. Insertion of the proper key into key hole 42 is thus the only manner of opening and closing latch 16. Preferably, a flange (not shown) is turned rearwardly from the lower edge of plate 126 in order to prohibit access to lever 22 from beneath the vehicle.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, I claim:

1. A locking device for a hood of a vehicle having a latch for releasably holding the hood closed and a movable release lever for releasing the latch to permit opening of the hood, said device comprising:

a bracket adapted to be mounted on the vehicle at a location adjacent the release lever;

lock means on said bracket including a plug supported on the bracket for rotational movement between a locked position wherein the plug is held against movement and an unlocked position;

key means for effecting movement of said plug between the locked and unlocked positions thereof; and cam means associated with said plug and acting in camming fashion in response to rotation of said plug to physically hold said release lever against movement when said plug is rotated to the locked position, thereby preventing release of the latch, said cam means releasing the release lever when said plug is rotated to the release position to permit movement of the release lever, thereby permitting the latch to be released for opening of the hood.

2. A device as set forth in claim 1, wherein said cam means includes:

a locking arm mounted on said bracket for pivotal movement between locking and release positions, said arm physically engaging said release lever in the locking position to prevent movement of the lever and disengaging from said release lever in the release position to permit movement of the lever for release of the hood; and a cam on said plug acting against said locking arm in a manner to move same to the locking position in response to rotation of said plug from the unlocked position to the locked position and to release the locking arm to permit movement of said locking arm to the release position in the unlocked position of said plug.

3. A device as set forth in claim 2, including yieldable means for biasing said locking arm toward the release position thereof.

4. A device as set forth in claim 3, wherein said release lever has a handle accessible from the exterior of the vehicle and said locking arm has a flange which in the locking position of the arm contacts said handle in a manner to prevent release of said lever.

5. A device as set forth in claim 3, wherein said bracket has a portion which covers said cam and yieldable means and most of said locking arm.

6. A device adapted for post manufacture installation on a vehicle having an engine hood, a latch for releasably holding the hood closed, a movable release lever for releasing the latch to permit opening of the hood, and a handle on the lever normally accessible from the exterior of the vehicle to effect movement of the lever for release of the latch, said device comprising:

a bracket adapted to be mounted on the vehicle at a preselected location adjacent the handle of the release lever, said bracket including a cover portion covering said handle forwardly thereof when said bracket is mounted at said preselected location;

lock means on said bracket including a plug supported on the bracket for rotational movement between first and second positions wherein the plug is held against rotation;

key means operable from the exterior of the vehicle for effecting movement of said plug between the first and second positions;

yieldable means for urging said latch toward a latched position wherein the hood is held closed; and a cam on said plug at a location behind the cover portion of said bracket, said cam acting against said handle of the release lever in camming fashion to release said lever to permit opening of the hood when said plug is rotated from the first position to the second position, and said cam permitting said yieldable means to move the latch to the latched position when the plug is rotated from the second position to the first position.

7. A device as set forth in claim 6, wherein said cam is arranged eccentrically with respect to said plug.

8. A device as set forth in claim 1, wherein:

said release lever has a handle accessible from the exterior of the vehicle to effect release of said lever; and said locking arm acts against said handle in the locked position of the plug to lock said handle against movement in a direction to effect release of said lever, said locking arm releasing from said handle in the unlocked position of the plug to permit movement of the lever for release of the latch.

* * * * *